US005374117A

United States Patent [19]

Herr et al.

[11] Patent Number: 5,374,117

[45] Date of Patent: * Dec. 20, 1994

[54] SIMPLIFIED ROTATING SHELF APPARATUS

[76] Inventors: Martin R. Herr, 127 Hill Rd., New Holland, Pa. 17557; David L. Herr, 83 N. Church St., Ephrata, Pa. 17522

[ * ] Notice: The portion of the term of this patent subsequent to Dec. 8, 2009 has been disclaimed.

[21] Appl. No.: 997,011

[22] Filed: Dec. 28, 1992

[51] Int. Cl.[5] ..... A47B 97/00

[52] U.S. Cl. ..... 312/238; 312/319.1; 49/254; 211/144

[58] Field of Search ..... 312/275, 238, 125, 135, 312/305, 319.1; 49/254; 211/95, 131, 144

[56] References Cited

U.S. PATENT DOCUMENTS

| | | | |
|---|---|---|---|
| 2,637,613 | 5/1953 | Motter | 312/238 |
| 2,698,776 | 1/1955 | Stoeckl | 312/238 |
| 3,281,197 | 10/1966 | Anderson | 312/238 |
| 4,181,037 | 1/1980 | Boon et al. | 312/238 |
| 4,418,970 | 12/1983 | Hyder et al. | 312/238 |
| 4,433,885 | 2/1984 | Baker | 312/238 |
| 4,440,459 | 4/1984 | Hallgren | 312/238 |
| 4,688,686 | 8/1987 | Mitts et al. . | |
| 4,764,075 | 8/1988 | Cox et al. | 312/71 X |
| 5,169,220 | 12/1992 | Herr et al. | 312/305 |

FOREIGN PATENT DOCUMENTS

| | | | |
|---|---|---|---|
| 2064964 | 9/1971 | Germany | 312/238 |
| 2556767 | 6/1977 | Germany | 312/238 |
| 2722629 | 9/1978 | Germany | 312/238 |
| 4009150 | 9/1991 | Germany | 312/238 |
| 195571 | 7/1964 | Sweden | 312/238 |

*Primary Examiner*—Brian K. Green
*Attorney, Agent, or Firm*—Martin Fruitman

[57] ABSTRACT

The apparatus is an apparatus for rotating a "lazy susan" shelf inside a cabinet. The apparatus uses a cam action to move the door back toward the axis and away from the cabinet edges as rotation begins upon opening, at the same time releasing a detent on the rotational motion of the shelves. As the shelf rotation position approaches the closure position of the door, the door moves gently out toward its closed position, and the door is automatically aligned. This is accomplished with a spring loaded support on the rotating shelf assembly which carries a roller that follows a stationary circular cam that has an indentation in it to activate the door's front to back movement. The forward motion of the door caused by the spring action is also slowed by a movement damper.

3 Claims, 1 Drawing Sheet

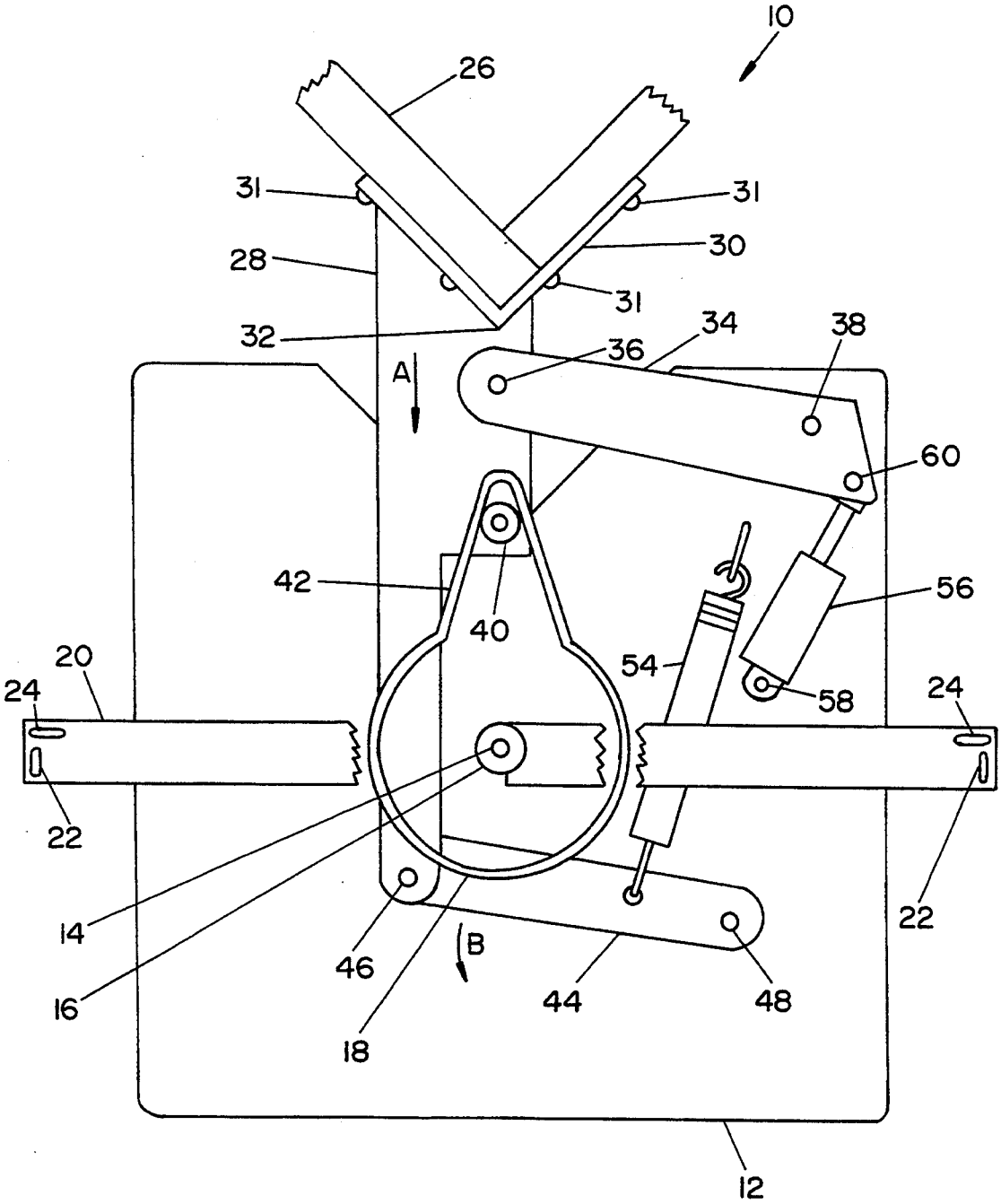
10
26
31
31
30
28
31
32
34
38
36
A
60
42
56
40
54
20
24
58
24
22
22
14
46
B
16
44
48
18
12

SIMPLIFIED ROTATING SHELF APPARATUS

BACKGROUND OF THE INVENTION

This invention deals generally with supports and cabinet structures, and more specifically with room corner cabinets of the type which include rotating shelves.

Corner cabinets are a familiar structure in modern kitchens, and such corner installations usually include a rotating shelf structure, sometimes referred to as a "lazy susan". These rotating systems are frequently used where counter tops are installed in the corner of a kitchen, because without them, the space under such corner counter tops is virtually inaccessible.

However, unless someone has actually lived with such a rotating shelf arrangement, the drawbacks are not always apparent. In fact, such rotating shelves, with their angled door forming the front of the cabinet structure when the door is closed, are a very effective "finger pincher", which invite painful accidents particularly with little children. Moreover, since this problem is greatly accentuated when the shelves of the rotating assembly are loaded with heavy cans of food which increase the rotating momentum of the assembly, the problem is not fully appreciated before the shelves are installed and loaded. This results in a painful learning process for the users of this type of shelf before the danger is fully appreciated, and the habit established of not resting one's fingers on the edges of the rotating door.

While there have been previous designs which attempted to solve this problem of pinched fingers, none of them have been satisfactory, usually because of the complexity of the motion required, but also because their installation usually required a specific cabinet or shelf structure. No previous solution used simple individual circular shelves, required no cabinet modification if they were to be installed on site, and still permitted simple adjustment for proper door fit.

Summary of the Invention

The present invention furnishes simple hardware for a rotating shelf and angled door arrangement, which can be installed after the cabinet is completely assembled, and, most important, will not pinch even the smallest fingers.

The present invention solves the mechanical problem by retracting only the door assembly, and thereby reducing the force necessary for the retraction motion, and the door is also maintained in the same horizontal plane, so that gravity need not be overcome upon opening the door or counteracted upon closing. Maintaining the door in the same horizontal plane is possible essentially because the accuracy of the door mechanism is such that it always returns to precisely the same closed location.

These features are accomplished by using an essentially circular cam attached to the inside bottom of the corner cabinet. This cam has a single discontinuity in its circumference, so that a cam follower mechanically linked to the door assembly rolls around on the inside of the circular cam and is affected by the discontinuity only when the door is exactly aligned with the rest of the cabinet front.

In the preferred embodiment, the discontinuity is a radial protrusion, and the cam follower is spring loaded to create a force to move it outward into the protrusion, away from the center of the near circular cam. The cam follower is linked to the door by a support so that the door moves radially outward into its closed position only after it is exactly aligned with the cabinet front. Thus, as the door's edges move past the cabinet's front edges, the door is always retracted inward from the cabinet edges, and there is no guillotine-like finger pinching mechanism available. In fact, if the shelves are spun rapidly, a favorite sport of some children, the door will not even move into its closed position, so that in this most dangerous situation, there will always be substantial clearance between the moving door edges and the stationary cabinet edges.

This effect of maintaining the door in its retracted position is enhanced by the use of a motion damper which counteracts the spring and only permits the door to move outward in a slow, gentle movement, further assuring that the door will not hurt anyone. Also, the outward protrusion of the cam is provided with a sloping path, so that even without the motion damper the radially outward motion of the door is not forceful.

The combination of the cam with a sloped protrusion and the motion damper counteracting the force of the spring permits the door retraction motion to be so quiet and so subtle that, without close examination, it is difficult to see that the door actually moves back from the cabinet edges before rotation begins. Nevertheless, if one's fingers are left on the cabinet edge, the absence of pain when the door rotates around to the front makes it quite clear that the mechanism is working, and doing its job quite well.

Furthermore, the simplified mechanism of the invention permits it to be constructed with very little height, and it can therefore be located entirely below the bottom shelf of the rotating structure and use up no significant storage space.

BRIEF DESCRIPTION OF THE DRAWINGS

The FIGURE is a bottom plan view of the preferred embodiment of the invention.

DETAILED DESCRIPTION OF THE INVENTION

The preferred embodiment of the invention is shown in the FIGURE which is a view of the mechanism of the invention from directly below the structure as it would be when installed on the bottom of a cabinet. In the FIGURE, rotating shelf apparatus 10 is mostly assembled upon support plate 12. Bearing 16, located at the approximate center of plate 12, connects plate 12 with axis 14 which extends upward (into the paper) into the cabinet within which rotating shelf apparatus 10 is installed. Plate 12 and most of the other components of rotating shelf apparatus 10 rotate around axis 14 as a unit.

Plate 12 is one of several shelf supports attached to rotating shelf apparatus 10 along axis 14 in order to permit the attachment of circular shelves (not shown) to support stored items. The additional shelf supports (not shown), other than plate 12, are attached to plate 12 by conventional methods such as by a leg welded to plate 12 and extending parallel to axis 14. However, the specific means for attachment of additional shelves is not a part of this invention.

One part of rotating shelf apparatus 10 which is not mounted upon plate 12 is cam 18 which is attached to the bottom of the cabinet within which apparatus 10 is installed. Cam 18 is attached to the bottom surface of such a cabinet by means of strap 20 which is attached to cam 18, and axis 14 is also attached to strap 20. Strap 20, only segments of which are shown in order to better view the other components, is attached to the cabinet bottom surface by the use of screws (not shown) through slots 22 and 24. Slots 22 and 24 are oriented in different directions to permit the adjustment of the location of axis 14 and cam 18 within the cabinet in order to align door 26 with the front of the cabinet. As will be appreciated from the following description, the location of axis 14 determines the closed position of corner door 26, which is intended to align with the front of the cabinet within which apparatus 10 is installed. In the FIGURE, door 26 is shown in its closed position, that is, in its position which is most distant from axis 14.

Door 26 is attached to plate 12 by a support assembly so that door 26 can rotate with plate 12, but door 26 can also move toward and away from axis 14 on an approximate radial path. Door 26 is attached to support 28 by being attached to angle plate 30 with screws 31. Angle plate 30 is welded to support 28 at corner 32.

When support 28, to which door 26 is attached, moves closer to axis 14, on path A, arm 34, attached to support 28 at pivot point 36, pivots on pivot point 38 which is attached to plate 12. The motion of support 28 is controlled by cam follower roller 40, also attached to support 28, as roller 40 moves inward on path A, out of cam protrusion 42, while following cam 18. A second pivoting arm 44 is oriented parallel to arm 34 and is also attached to support 28 at its own pivot point 46 while being attached to plate 12 at pivot point 48.

The motion of cam follower roller 40 inward on path A is initiated by any torque applied to door 26 to rotate the door. As roller 40 moves along the slope of cam protrusion 42, roller 40 is forced inward, and support 28 and door 26 move along with roller 40. Regardless of the direction of rotation of plate 12, cam follower roller 40 will move out of cam protrusion 42, and therefore door 26, which moves with roller 40, will also move inward toward axis 14.

The inward motion of roller 40 on path A is counteracted by the action of spring 54 which acts against the rotation of arm 44 and pivot point 46 in the direction of arrow B around pivot point 48. Since pivot point 46 moves with support 28 to which door 26 is attached, pivot point 46 moves in direction B when cam follower roller 40 moves in direction A, out of protrusion 42. However, movement of arm 44 in direction B also stretches spring 54, so that when cam follower roller 40 is opposite protrusion 42, and not held inward by the surface of cam 18, spring 54 causes cam follower roller 40 to move outward, opposite to arrow A, and door 26 also moves outward, into its closed position. Thus, by means of spring 54, cam follower 40 is constantly urged outward unless prevented by the shape of cam 18, and therefore door 26 is held out away from axis 14 by spring 54, but when plate 12 rotates into any position which takes cam follower roller 40 out of protrusion 42, door 26 is held in toward axis 14.

The shape and slope of protrusion 42 in cam 18 can be chosen to make the apparatus and motion described above quite satisfactory to accomplish the purpose of the invention to assure that door 26 always retracts when rotation is initiated and that door 26 stays retracted until it is exactly aligned for closure. However, it has been found that the safety of the apparatus can be further enhanced by slowing the outward movement of door 26 by means other than a gradual slope of cam protrusion 42, so that even when aligned properly, the door does not move out with any significant force. This feature is attained by the addition of a damper to slow the movement.

As seen in the FIGURE, conventional hydraulic damper 56 is attached to plate 12 at attachment point 58 and is also attached to arm 34 at attachment point 60. Thus, the motion of arm 34 and cam follower 40 outward and the motion of door 26 outward is changed to a gentle, yet forceful, motion, and prevented from being at all violent. It is virtually impossible for anyone's fingers to be pinched, because damper 56 assures that there will always be clearance between the door and cabinet edges as the door moves past the cabinet edge, and that there will therefore be no slicing motion because the door will move gently radially outward only after it has cleared the cabinet edges.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the exact configuration shown for the pivoting arms could be modified, or damper 56 could be pneumatic rather than hydraulic.

What is claimed as new and for which Letters patent of the United States are desired to be secured is:

1. An apparatus for rotating shelves and retracting a door rotating with the shelves, comprising:

a fixed cam, the cam having a continuous cam surface with a protrusion at one location on the surface and the cam surface determining a plane;

a plate which is a shelf support rotatable on an axis, the axis being located within an area enclosed by the cam surface, with the axis being perpendicular to the plane of the cam surface;

a door support interconnected to the plate by at least one moveable connection so that the door support moves in a path approximately parallel to the plane of the cam surface, with the door support moving on a path which approaches the axis;

a cam follower attached to the door support and held in continuous contact with the cam and acting upon the door support in a manner so that, as the cam follower follows the protrusion on the cam surface, the door support changes its distance from the axis;

a force applying means interconnected with the cam follower so that the force applying means maintains the cam follower in contact with the cam surface as the plate rotates and causes the cam follower to follow the protrusion on the cam surface when the cam follower is aligned with the protrusion; and a door attached to the door support.

2. The apparatus of claim 1 further including a motion damper interconnected with the door support and acting to limit the speed of the movement of the door support as the door support moves away from the axis.

3. The apparatus of claim 2 wherein the motion damper is a hydraulic damper which slows the motion of the door support.

* * * * *